US006184669B1

(12) United States Patent
Matsuo

(10) Patent No.: US 6,184,669 B1
(45) Date of Patent: Feb. 6, 2001

(54) CURRENT CONTROL CIRCUIT

(75) Inventor: Kouichi Matsuo, Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 09/580,566

(22) Filed: May 30, 2000

(30) Foreign Application Priority Data

Nov. 30, 1999 (JP) ..... 11-339322

(51) Int. Cl.[7] ..... G05F 5/00

(52) U.S. Cl. ..... 323/303; 323/273; 323/277; 323/908

(58) Field of Search ..... 323/273, 303, 323/274, 275, 276, 277, 908

(56) References Cited

U.S. PATENT DOCUMENTS 4,495,536 * 1/1985 Bynum ..... 323/277

5,257,126 * 10/1993 Kirkpatrick ..... 323/901

FOREIGN PATENT DOCUMENTS 8-98393 4/1996 (JP) .

* cited by examiner

*Primary Examiner*—Shawn Riley

(74) *Attorney, Agent, or Firm*—Staas & Halsey LLP

(57) ABSTRACT

There is disclosed a current control circuit, disposed between a primary terminal and a secondary terminal, for controlling a current flowing from the primary terminal to the secondary terminal. An overcurrent flowing through a resistance R1 is detected by a PNP transistor. A maximum value of a current flowing through a MOSFET is determined by a voltage dropped by a voltage drop correspondence by a diode from a voltage of the collector of the PNP transistor.

7 Claims, 4 Drawing Sheets

CURRENT CONTROL CIRCUIT

BACKGROUND OF THE INVENTION

1. Field of the Invention

The present invention relates to a current control circuit, disposed between a primary terminal and a secondary terminal, for controlling a current flowing from the primary terminal to the secondary terminal.

2. Description of the Related Art

Hitherto, there is known a rush current preventing circuit, disposed between a source output terminal of a power supply and a source input terminal of an arbitrary electronic circuit, for preventing a rush current so that an output of the power supply does not exceed a predetermined rated output.

Further, there is known an overcurrent detection circuit for detecting an overcurrent to prevent fumes and going up in flames from occurring even if the electronic circuit of the secondary is subjected to a short-circuit and the like, while a sufficient current is supplied even if the maximum load is involved within a usual operating range of the electronic circuit of the secondary.

FIG. 4 is a circuit diagram of a current control circuit according to an embodiment of the present invention. a circuit diagram showing a state that both the rush preventing circuit and the overcurrent detection circuit are provided.

Usually, a considerably large capacity of capacitor C is disposed at the secondary. At the time of a power supply is turned on, a rush current will occur for a charge of the capacitor C and the like. The rush preventing circuit is disposed to prevent the primary power supply from being damaged by the rush current. Further, the overcurrent detection circuit is connected in series to the rush preventing circuit to prevent an overcurrent from conducting when an electronic circuit connected to the secondary is subjected to a short-circuit and the like. When the overcurrent detection circuit detects the overcurrent, a detection result is transmitted to an overcurrent recognition circuit (not illustrated). Thus, the overcurrent recognition circuit recognizes that the overcurrent, which is not to be accepted, conducts. And then the overcurrent is suppressed by an overcurrent control circuit (also not illustrated).

According to the circuit constitution as shown in FIG. 4, both the rush preventing circuit and the overcurrent detection circuit are provided on a current path directed from the primary to the secondary. This constitution brings about power loss on the respective circuits and voltage drop at the secondary. This causes shortage of ability in operation for the electronic circuits connected to the secondary, or alternatively increments of a circuit scale and a circuit cost for suppressing power loss on the rush preventing circuit and the overcurrent detection circuit to avoid the occurrence of the shortage of ability in operation for the electronic circuits.

Individual provision of the rush preventing circuit and the overcurrent detection circuit as shown in FIG. 4 brings about necessity for design and test of respective circuits. This involves an increment of process.

SUMMARY OF THE INVENTION

In view of the foregoing, it is an object of the present invention to provide a current control circuit for controlling a current flowing from the primary to the secondary, the current control circuit being capable of reducing power loss and voltage drop.

To achieve the above-mentioned object, the present invention provides a current control circuit, disposed between a primary terminal and a secondary terminal, for controlling a current flowing from the primary terminal to the secondary terminal, said current control circuit comprising:

a first resistance disposed on a current path directed from the primary terminal to the secondary terminal;

a MOSFET, in which its drain and source are connected in series to said first resistance, disposed between said first resistance and the secondary terminal, said MOSFET permitting a maximum permissible current or less current to conduct in accordance with a voltage applied to its gate;

a PNP transistor in which its emitter is connected to a primary of said first resistance and its base is connected to the secondary of said first resistance; and a voltage drop device, disposed between the collector of said PNP transistor and the gate of said MOSFET, for supplying to the gate of said MOSFET a voltage dropped by a predetermined potential from a voltage of the collector of said PNP transistor.

According to the current control circuit of the present invention as mentioned above, when a current flows through the first resistance, there is generated a voltage between the primary and the secondary of the first resistance, which voltage is proportional to the current thus flowed. This voltage makes it possible to derive as an overcurrent detection signal a signal outputted from the collector of the PNP transistor when the PNP transistor turns on. Further, when the overcurrent occurs, the voltage drop device connected to the collector of the PNP transistor causes a gate-to-source voltage of the MOSFET disposed between the first resistance and the secondary terminal to be lowered, and thus the drain current is subjected to a constant current control with a somewhat larger current value than the overcurrent detection current.

In this manner, according to the current control circuit of the present invention, simply disposing one resistance (the first resistance) and one MOSFET between the primary terminal and the secondary terminal makes it possible to implement a circuit capable of performing both the overcurrent detection and the rush current prevention, through suppressing power loss and voltage drop to the minimum.

In the current control circuit of the present invention as mentioned above, it is preferable that said voltage drop device is a diode of which an anode is connected to the collector of said PNP transistor. Or alternatively, it is acceptable that said voltage drop device is a Zener diode of which a cathode is connected to the collector of said PNP transistor.

In the current control circuit of the present invention as mentioned above, it is preferable that a capacitor is connected in parallel to said voltage drop device.

In the event that a large capacity of capacitor is connected to the secondary, when the power supply of the primary turns on, or when the motor of the secondary is activated, it happens that a current exceeding a set value flows transitionally owing to a delay in operational time of the voltage drop device. This problem is solved in accordance with the present invention. That is, connecting a capacitor in parallel to the voltage drop device makes it possible to reduce the response time and thereby suppressing generation of a transitional large current.

In the current control circuit of the present invention as mentioned above, it is preferable that a second resistance is connected between the base of said PNP transistor and the emitter of said PNP transistor, and the base of said PNP transistor is connected via a third resistance to a secondary of said first resistance. In this case, it is preferable that at least one of said second resistance and said third resistance is a variable resistance.

In some load of the secondary, there is a need to alter the criterion of the overcurrent to be regarded as it. Here, as the first resistance, in order to lower the voltage drop, there is used a resistance which is the low impedance and is high in heat capacity, and usually the sort of such a resistance is restricted. Therefore, it is not effective that the first resistance is altered whenever the secondary load is altered. For this reason, as mentioned above, the second resistance and the third resistance, which are connected in series to one another, are connected in parallel to the first resistance, so that a voltage is divided by the second resistance and the third resistance. This feature makes easy to alter the current value to be detected as the overcurrent. Here, the use of a variable resistance for the second resistance or the third resistance makes more easy to adjust the alteration.

In the current control circuit of the present invention as mentioned above, it is preferable that said current control circuit further comprises an overcurrent control circuit for monitoring a signal of the collector of said PNP transistor, and supplying to the gate of said MOSFET a voltage to turn off said MOSFET when it is detected that a current exceeding a predetermined value of current flows through the current path over a predetermined time continuously.

For example, in the event that a motor is connected as a load, when the motor is activated, a considerable large current will flow so that the overcurrent detection signal turns on. Thereafter, when the number of rotation of the motor is increased to be constant, the current value is decreased so that the overcurrent detection signal turns off. On the other hand, when the short-circuit occurs on the secondary circuit, the overcurrent detection signal is kept turn on.

For this reason, as mentioned above, when a current exceeding a predetermined value of current flows over a predetermined time continuously, the MOSFET is turned off. Thus, it is possible to prevent fumes and going up in flames due to the overcurrent from occurring without disturbing the normal operation of the secondary circuit.

DETAILED DESCRIPTION OF PREFERRED EMBODIMENTS

Embodiments of the present invention will be described with reference to the accompanying drawings.

Figure 1:
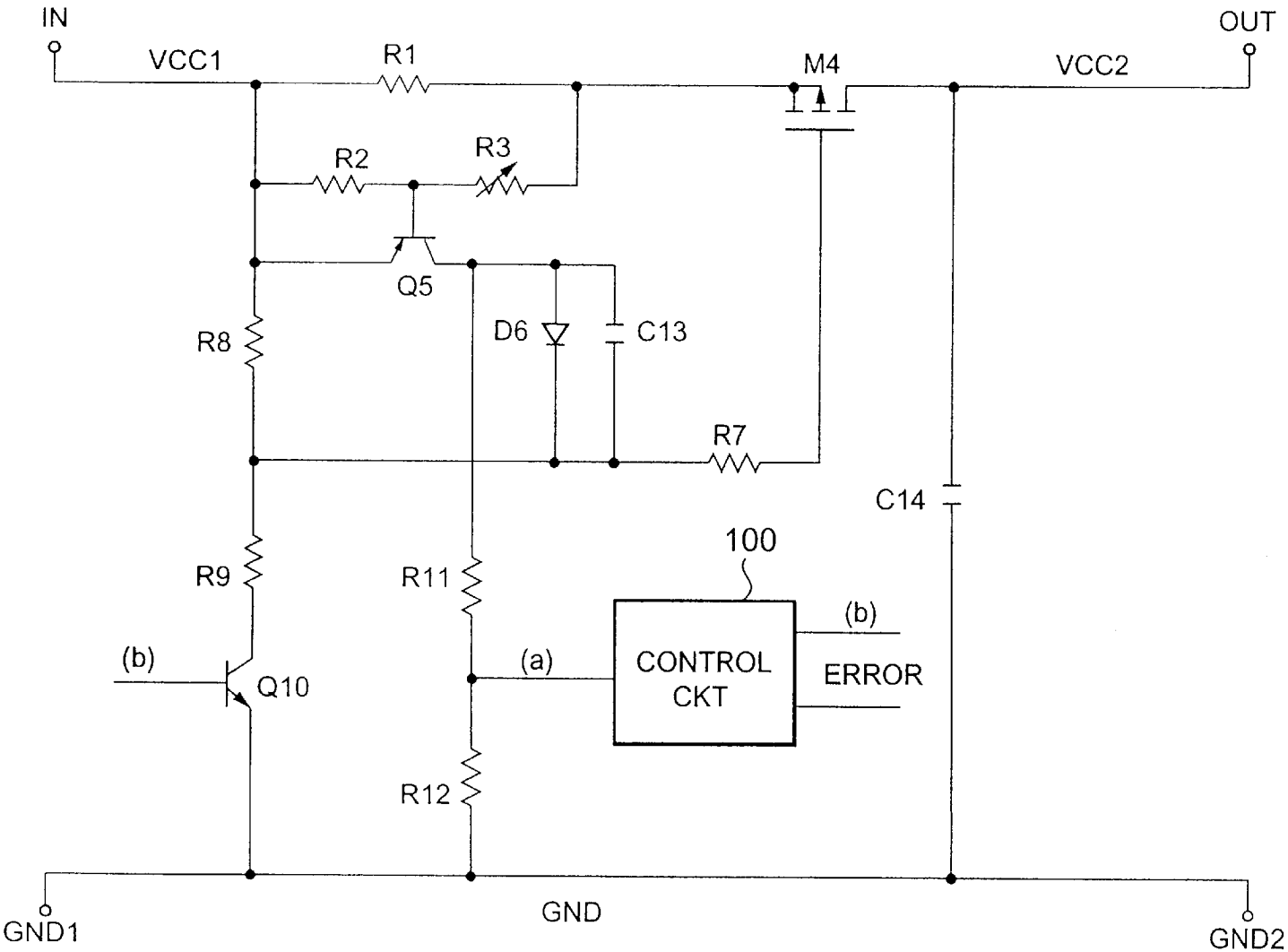
FIG. 1 is a circuit diagram of a current control circuit according to an embodiment of the present invention.

FIG. 1 is a circuit diagram of a current control circuit according to an embodiment of the present invention.

The current control circuit has a primary terminal IN connected to a primary power source, a ground terminal GND1 associated with the primary terminal IN, a secondary terminal OUT to supply a current from the current control circuit to a secondary electronic circuit (not illustrated), and a ground terminal GND2 associated with the secondary terminal OUT. The current control circuit controls a current flowing from the primary terminal IN to the secondary terminal OUT.

A first resistance R1 is disposed on a current path directed from the primary terminal IN to the secondary terminal OUT. A MOSFET M4, in which its drain and source are connected in series to the first resistance R1, is disposed between the first resistance R1 and the secondary terminal OUT. The MOSFET M4 permits the maximum permissible current or less current to conduct in accordance with a voltage applied to its gate.

The current control circuit is provided with a PNP transistor Q5 in which its emitter is connected to the primary of the first resistance R1 and its base is connected via a variable resistance R3 to the secondary of the first resistance R1. Between the collector of the PNP transistor Q5 and the gate of the MOSFET M4, there is disposed a diode D6 (an example of a voltage drop device referred to in the present invention) for supplying to the gate of the MOSFET M4 a voltage dropped by a predetermined potential (e.g. 0.7 volts) from a voltage of the collector of the PNP transistor Q5. An anode of the diode D6 is connected to the collector of the PNP transistor Q5, and a cathode of the diode D6 is connected via a resistance R7 to the gate of the MOSFET M4.

A capacitor C13 is connected in parallel to the diode D6.

Figure 2:
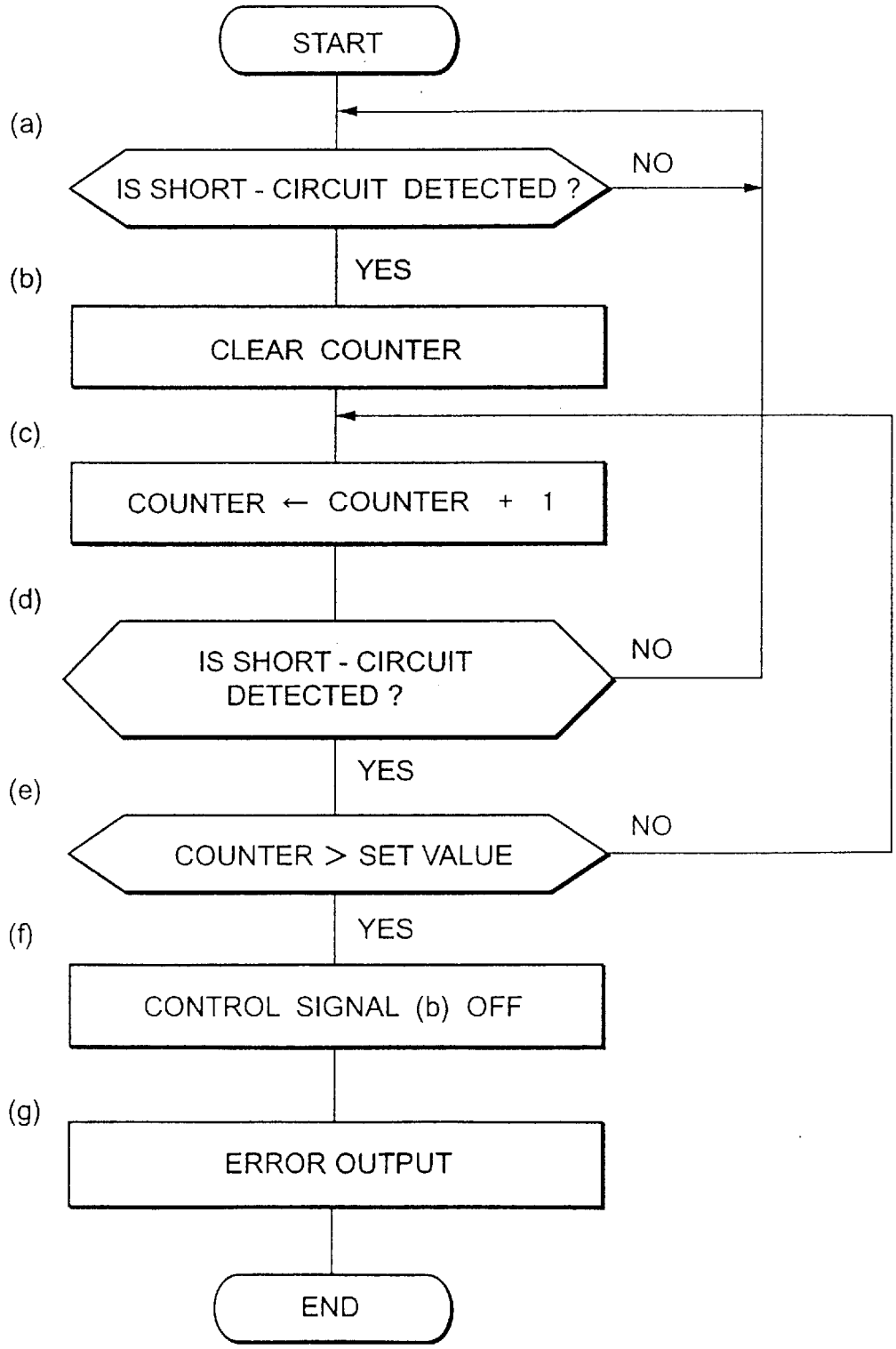
FIG. 2 is a flowchart useful for understanding an operation of a control circuit.

Between the collector of the PNP transistor Q5 and a ground line GND, two resistance R11 and resistance R12 are connected in series. At the connecting point between the resistance R11 and the resistance R12, there is provided a control circuit 100 for monitoring a signal of the collector of the PNP transistor Q5, that is, a signal in a state that a voltage of the collector of the PNP transistor Q5 is divided by the resistance R11 and the resistance R12. As shown in FIG. 2 which will be described later, the control circuit 100 supplies to the gate of the MOSFET M4 a voltage to turn off the MOSFET M4 when it is detected that a current exceeding a predetermined value of current flows through a current path between the primary terminal IN and the secondary terminal OUT over a predetermined time continuously. Details of an operation of the control circuit 100 will be described later.

Between the emitter and the base of the PNP transistor Q5, a second resistance R2 is connected. Between the primary side of the first resistance R1 and the cathode of diode D6, a resistance R8 is connected. Between the connecting point of the first resistance R1 to the cathode of diode D6 and the ground line GND, a resistance R9 and collector and emitter of an NPN transistor Q10 are connected in series. A base of the NPN transistor Q10 receives a control signal (b) outputted from the control circuit 100.

Further, between the secondary terminal OUT and the ground terminal GND2, a capacitor C14 for stabilizing a voltage of the secondary side is connected.

In the current control circuit, if the NPN transistor Q10 is kept turn on in accordance with the control signal (b) outputted from the control circuit 100, a voltage Vcc1 on the primary terminal IN is divided by two resistances R8 and R9 and then applied to the gate of the MOSFET M4, so that the MOSFET M4 turns on. In a state that a load circuit is connected to the secondary side and is operating normally, this condition is kept.

Here, let us consider, for example, a situation that a short-circuit occurs in the load circuit and thus an overcurrent flows from the primary terminal IN to the secondary terminal OUT.

A current value, which is regarded as an overcurrent, can be determined as follows.

In the event that a base-to-emitter voltage Vbe of the PNP transistor Q5 is about 0.6 V, the first resistance R1 is sufficiently smaller as compared with a resistance which is a sum of the second resistance R2 and a variable resistance R3, and a base current of the PNP transistor Q5 can be neglected, a current Ioc, which is detected in form of the overcurrent, is given by the following formula.

$$Ioc=\{(Vbe/R2)\times(R2+R3)\}/R1 \quad (1)$$

where R1, R2 and R3 denote values of resistance of the resistances R1, R2 and R3, respectively.

Vbe is substantially constant. Therefore, determination of R1, R2 and R3 according to the formula (1) makes it possible to establish the overcurrent with a desired current.

In the event that a short-circuit occurs in the secondary side and a current exceeding the current Ioc, which is determined in accordance with the formula (1), flows through the first resistance R1, a voltage is applied to the gate of the MOSFET M4 through the diode D6, so that a gate-to-source voltage Vgs of the MOSFET M4 becomes small and thereby preventing the drain current of the MOSFET M4 from flowing over a predetermined current value. The drain current at that time is the maximum supply current. When the maximum supply current is expressed by Imax, the following formula is applied.

$$Imax>Ioc \quad (2)$$

In the event that a forward voltage of the diode D6 is expressed by Vf, and the gate-to-source voltage of the MOSFET M4 is expressed by Vgs when the drain current of the MOSFET M4 is Ioc, the drain current Imax, which is involved in about Vgs+Vf, can be determined.

When the overcurrent flows so that the PNP transistor Q5 turns on, the capacitor C13, which is connected in parallel to the diode D6, immediately transmits the overcurrent detection signal appearing on the collector of the PNP transistor Q5 to the gate of the MOSFET M4 to improve a speed of response of the current limit of the MOSFET M4.

The overcurrent detection signal appearing on the collector of the PNP transistor Q5 is divided in voltage by the resistances R11 and R12. A divided signal (a) is monitored by the control circuit 100. An operation of the control circuit 100 will be described in conjunction with FIG. 2 hereinafter.

FIG. 2 is a flowchart useful for understanding an operation of the control circuit.

First, in a step (a), a short-circuit (an overcurrent) is detected, while it is repeatedly monitored as to whether the short-circuit occurs in a usual state in which no short-circuit occurs.

When the short-circuit (the overcurrent) is detected in the step (a), the process goes to a step (b) in which a counter for counting time is reset. In a step (c), the counter is incremented. In a step (d), the short-circuit (the overcurrent) is detected again. In the event that no short-circuit (the overcurrent) is detected, the process returns to the step (a) in which it is repeatedly monitored as to whether the short-circuit occurs in the usual state.

In the step (d), when the short-circuit is detected too, the process goes to a step (e) in which it is determined whether the count value of the counter exceeds a set value. When it is decided that the count value of the counter does not exceed the set value, the process returns to the step (c) in which the counter is incremented, and in the step (d) the short-circuit is detected. In the step (d), when no short-circuit is detected before the count value of the counter exceeds the set value, it is regarded as no actual short-circuit and then the process returns to the step (a) in which it is repeatedly monitored as to whether the short-circuit occurs in the usual state.

On the other hand, when a short-circuit is detected before the count value of the counter exceeds the set value, the process goes to a step (f) in which the control signal (b) turns off ('L' level) so that the NPN transistor Q10 turns off. Thus, the primary voltage VCC1 is applied via the resistances R8 and R7 to the gate of the MOSFET M4, so that the MOSFET M4 turns off completely. Therefore, a current flowing from the primary terminal IN to the secondary terminal OUT is completely cut off. Further, the control circuit 100 generates an error signal (step (g)) so that a display (not illustrated) or the like displays that an abnormality occurs.

As mentioned above, according to the embodiment shown in FIGS. 1 and 2, the rush current preventing circuit and the overcurrent detection circuit are integrated to form the current control circuit. This feature makes it possible to improve a loss of the overcurrent detection circuit, a shortage in operating ability of a load due to a voltage drop of the secondary side, a circuit scale, a circuit cost, and the number of man-hour for design and verification. Further, according to the embodiment shown in FIGS. 1 and 2, when the overcurrent occurs, it is possible to discriminate whether the overcurrent is a power closing current occurred at the time when a power supply turns on or a current due to a short-circuit or the like, and thereby stopping the current supply only when the short-circuit or the like occurs.

Figure 3:
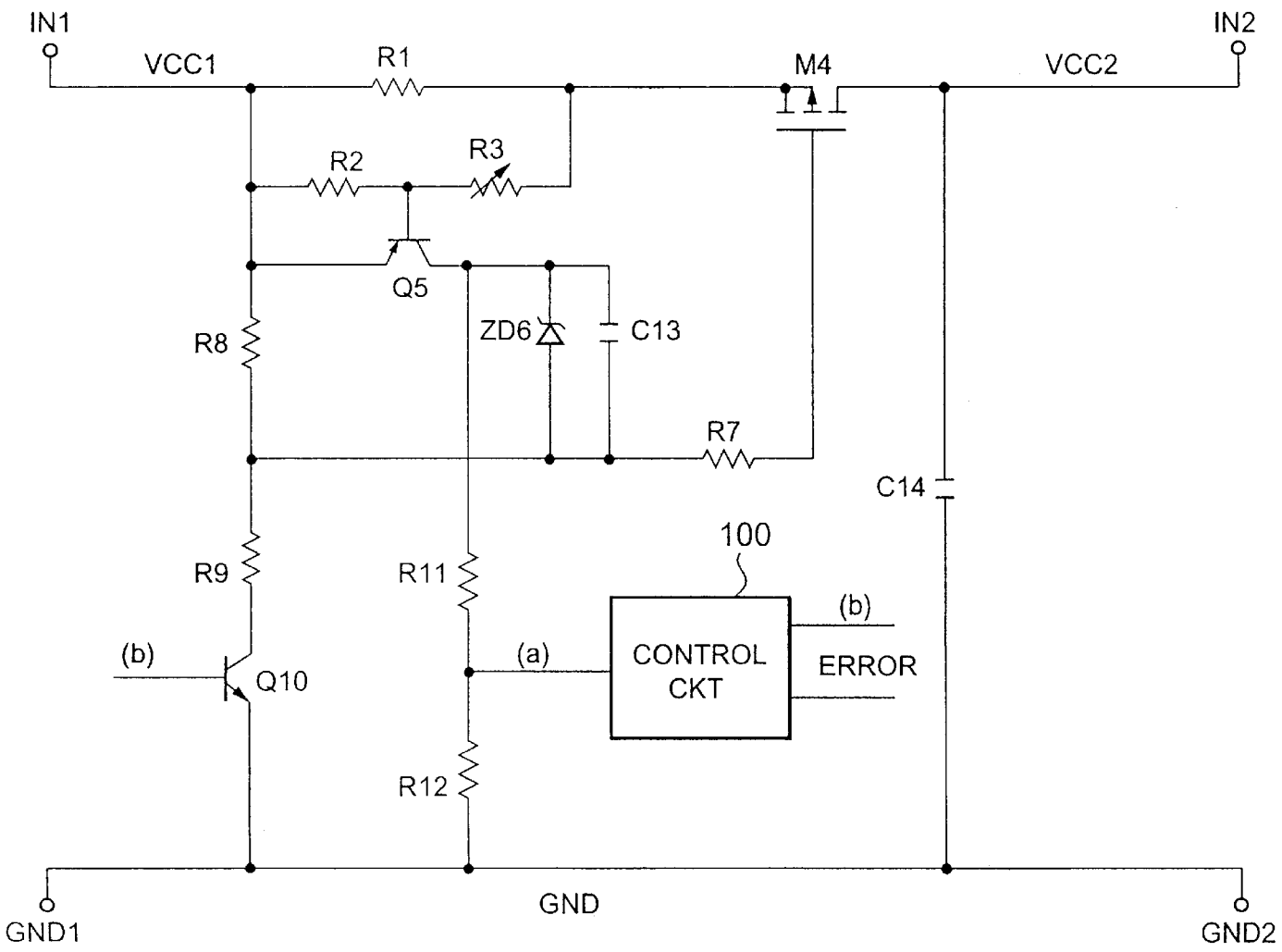
FIG. 3 is a circuit diagram of a current control circuit according to an alternative embodiment of the present invention.
Figure 4:
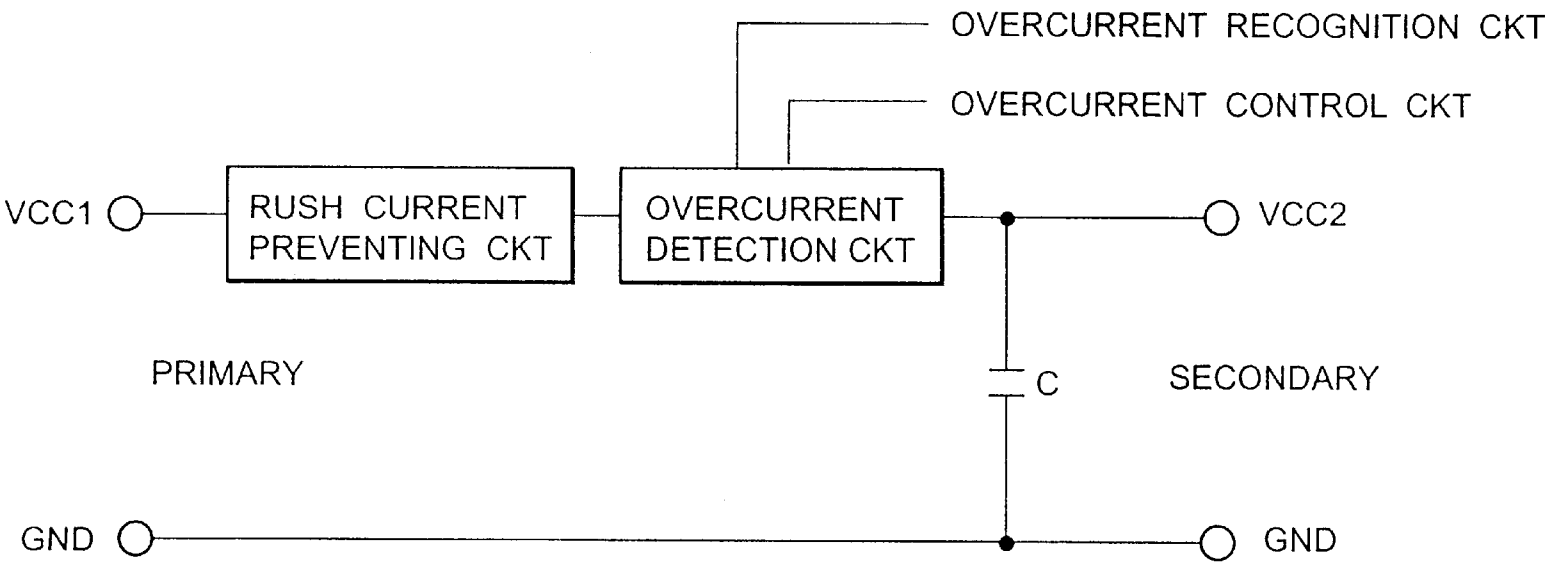
FIG. 4 is a circuit diagram showing a state that both the rush preventing circuit and the overcurrent detection circuit are provided.

FIG. 3 is a circuit diagram of a current control circuit according to an alternative embodiment of the present invention.

In the current control circuit shown in FIG. 3, instead of the diode D6 in the current control circuit shown in FIG. 3, there is provided a Zener diode ZD6 of which cathode and anode are connected to the collector of the PNP transistor Q5 and the MOSFET M4, respectively. The Zener diode ZD6 serves to provide the voltage drop.

In this manner, it is acceptable that the Zener diode ZD6 is adopted instead of the diode D6.

According to the above-mentioned embodiments, while the resistance R3, of the resistances R2 and R3, is selected as a variable resistance, it is acceptable that the resistance R2 is selected as a variable resistance, or alternatively it is acceptable that both the resistances R2 and R3 are selected as a variable resistance.

As mentioned above, according to the present invention, it is possible to provide a current control circuit capable of reducing power loss and voltage drop.

While the present invention has been described with reference to the particular illustrative embodiments, it is not to be restricted by those embodiments but only by the appended claims. It is to be appreciated that those skilled in the art can change or modify the embodiments without departing from the scope and sprit of the present invention.

What is claimed is:

1. A current control circuit, disposed between a primary terminal and a secondary terminal, for controlling a current flowing from the primary terminal to the secondary terminal, said current control circuit comprising:

a first resistance disposed on a current path directed from the primary terminal to the secondary terminal;

a MOSFET, in which its drain and source are connected in series to said first resistance, disposed between said first resistance and the secondary terminal, said MOSFET permitting a maximum permissible current or less current to conduct in accordance with a voltage applied to its gate;

a PNP transistor in which its emitter is connected to a primary of said first resistance and its base is connected to the secondary of said first resistance; and a voltage drop device, disposed between the collector of said PNP transistor and the gate of said MOSFET, for supplying to the gate of said MOSFET a voltage dropped by a predetermined potential from a voltage of the collector of said PNP transistor.

2. A current control circuit according to claim 1, wherein said voltage drop device is a diode of which an anode is connected to the collector of said PNP transistor.

3. A current control circuit according to claim 1, wherein said voltage drop device is a Zener diode of which a cathode is connected to the collector of said PNP transistor.

4. A current control circuit according to claim 1, wherein a capacitor is connected in parallel to said voltage drop device.

5. A current control circuit according to claim 1, wherein a second resistance is connected between the base of said PNP transistor and the emitter of said PNP transistor, and the base of said PNP transistor is connected via a third resistance to a secondary of said first resistance.

6. A current control circuit according to claim 5, wherein at least one of said second resistance and said third resistance is a variable resistance.

7. A current control circuit according to claim 1, wherein said current control circuit further comprises an overcurrent control circuit for monitoring a signal of the collector of said PNP transistor, and supplying to the gate of said MOSFET a voltage to turn off said MOSFET when it is detected that a current exceeding a predetermined value of current flows through the current path over a predetermined time continuously.

* * * * *